US006352820B1

(12) United States Patent
Bauer et al.

(10) Patent No.: US 6,352,820 B1
(45) Date of Patent: Mar. 5, 2002

(54) THERMALLY DEVELOPABLE IMAGING MATERIALS CONTAINING POLYESTER POLYMERIC BARRIER LAYER

(75) Inventors: Charles L. Bauer, Webster; Michelle L. Horch, Rochester; Anne M. Miller, Batavia; Paul D. Yacobucci, Rochester, all of NY (US); Takuzo Ishida, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/821,983

(22) Filed: Mar. 30, 2001

(51) Int. Cl.[7] ..... G03C 1/498; G03C 1/76

(52) U.S. Cl. ..... 430/353; 430/533; 430/618; 430/620; 430/619; 430/961; 430/964

(58) Field of Search ..... 430/353, 533, 430/618, 620, 619, 961, 964

(56) References Cited

U.S. PATENT DOCUMENTS 5,422,234 A 6/1995 Bauer et al. ..... 430/961
5,989,796 A 11/1999 Moon ..... 430/961
6,001,550 A 12/1999 Yacobucci et al. ..... 430/533
6,146,822 A * 11/2000 Asanuma et al. ..... 430/965

OTHER PUBLICATIONS

U.S. application No. 09/728,416, R.J. Kenney et al, filed Dec. 1, 2000, "High Contrast Thermally–Developable Imaging Materials Containing Barrier Layer", (D–80075).

U.S. application No. 09/729,256, A.M. Miller et al, filed Dec. 1, 2000, "Thermally–Developable Imaging Materials Containing Surface Barrier Layer", (D–81465).

* cited by examiner

*Primary Examiner*—Richard L. Schilling
(74) *Attorney, Agent, or Firm*—J. Lanny Tucker

(57) ABSTRACT

Thermographic and photothermographic materials comprise a barrier layer to provide physical protection and to prevent migration of diffusible imaging components and by-products resulting from high temperature development. The barrier layer comprises a film-forming, water-insoluble aromatic polyester that has a molecular weight of at least 10,000 g/mole and is capable of retarding diffusion of mobile chemicals such as fatty acids, developers and toners. This polymer can also be present in admixture with another film-forming polymer to provide a clear and scratch-resistance surface.

30 Claims, No Drawings

THERMALLY DEVELOPABLE IMAGING MATERIALS CONTAINING POLYESTER POLYMERIC BARRIER LAYER

FIELD OF THE INVENTION

This invention relates to thermally developable imaging materials such as thermographic and photothermographic materials. More particularly, it relates to thermographic and photothermographic imaging materials having improved physical protection by the presence of a unique barrier layer. The invention also relates to methods of imaging using these materials. This invention is directed to the photothermographic and thermographic imaging industries.

BACKGROUND OF THE INVENTION

Silver containing thermographic and photothermographic imaging materials that are developed with heat and without liquid development have been known in the art for many years.

Thermography or thermal imaging is a recording process wherein images are generated by the use of thermal energy. In direct thermography, a visible image is formed by imagewise heating a recording material containing matter that changes color or optical density upon heating. Thermographic materials generally comprise a support having coated thereon: (a) a relatively or completely non-photosensitive source of reducible silver ions, (b) a reducing composition (usually including a developer) for the reducible silver ions, and (c) a hydrophilic or hydrophobic binder.

Thermographic recording materials become photothermographic upon incorporating a photosensitive catalyst such as silver halide. Upon imagewise exposure to irradiation energy (ultraviolet, visible, or IR radiation) the exposed silver halide grains form a latent image. Application of thermal energy causes the latent image of exposed silver halide grains to act as a catalyst for the development of the non-photosensitive source of reducible silver to form a visible image. These photothermographic materials are also known as "dry silver" materials.

In such materials, the photosensitive catalyst is generally a photographic type photosensitive silver halide that is considered to be in catalytic proximity to the non-photosensitive source of reducible silver ions. Catalytic proximity requires an intimate physical association of these two components either prior to or during the thermal image development process so that when silver atoms, $(Ag^0)_n$, also known as silver specks, clusters or nuclei are generated by irradiation or light exposure of the photosensitive silver halide, those silver atoms are able to catalyze the reduction of the reducible silver ions within a catalytic sphere of influence around the silver atoms [Klosterboer, *Imaging Processes and Materials*(*Neblette's Eighth Edition*), Sturge, Walworth & Shepp (Eds.), Van Nostrand-Reinhold, New York, Chapter 9,pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, Item No. 17029). Other photosensitive materials, such as titanium dioxide, zinc oxide, and cadmium sulfide have also been reported as useful in place of silver halide as the photocatalyst in photothermographic materials [see, for example, Shepard, *J Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in situ, " for example by mixing an organic or inorganic halide-containing source with a source of reducible silver ions to achieve partial metathesis and thus causing the in-situ formation of silver halide (AgX) grains on the surface of the silver source [see for example, U.S. Pat. No. 3,457,075 (Morgan et al.)].

The silver halide may also be "preformed" and prepared by an "ex situ " process whereby the silver halide (AgX) grains are prepared and grown separately. With this technique, one has the possibility of controlling the grain size, grain size distribution, dopant levels, and composition much more precisely, so that one can impart more specific properties to both the silver halide grains and photothermographic material. The preformed silver halide grains may be introduced prior to and be present during the formation of the silver soap. Co-precipitation of the silver halide and source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid (such as a silver fatty acid carboxylate) having from 10 to 30 carbon atoms, or mixtures of such salts. Such acids are also known as "fatty acids". Salts of other organic acids or other organic compounds, such as silver imidazolates, silver benzotriazoles, silver tetrazoles, silver benzotetrazoles, silver benzothiazoles and silver acetylides have been proposed. U.S. Pat. No. 4,260,677 (Winslow et al.) discloses the use of complexes of various non-photosensitive inorganic or organic silver salts.

In photothermographic emulsions, exposure of the photosensitive silver halide to light produces small clusters of silver atoms, $(Ag^0)_n$. The imagewise distribution of these clusters known in the art as a latent image, is generally not visible by ordinary means. Thus, the photosensitive emulsion must be further developed to produce a visible image. This is accomplished by the reduction of silver ions that are in catalytic proximity to silver halide grains bearing the clusters of silver atoms (that is, the latent image). This produces a black-and-white image. The non-photosensitive silver source is reduced to form the visible black-and-white negative image while much of the silver halide, generally, remains as silver halide and is not reduced.

In photothermographic materials, the reducing agent for the non-photosensitive reducible silver ions, often referred to as a "developer," may be any compound that in the presence of the latent image, can reduce silver ions to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reduction occurs preferentially in the regions surrounding the latent image. In photothermographic materials, this reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing using aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus imaged, the photosensitive silver halide serves as a catalyst for the physical development of the non-photosensitive source of reducible silver ions. In contrast, conventional wet-processed, black-and-white photographic materials use only one form of silver (that is, silver halide) that, upon chemical development, is itself converted into the silver image. Thus, photothermographic materials require an amount of silver halide per unit area that is only a fraction of that used in conventional wet-processed photographic materials.

In photothermographic materials, all of the "chemistry" for imaging is incorporated within the material itself. For example, they include a developer (that is, a reducing agent for the reducible silver ions) while conventional photographic materials usually do not. Even in so-called instant photography, the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, storage, and post-processing handling.

Moreover, in photothermographic materials, the unexposed silver halide generally remains intact after development and the material must be stabilized against further imaging and development. In contrast, the silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they pose different considerations and present distinctly different problems in manufacture and use, compared to conventional, wet-processed silver halide materials.

These and other distinctions between photothermographic and photographic materials are described in *Imaging Processes and Materials*(*Neblette 's Eighth Edition*), noted above, *Unconventional Imaging Processes*, E. Brinckman et al (Eds.), The Focal Press, London and New York, 1978, pp. 74–75, and in Zou, Sahyun, Levy and Serpone, *J. Imaging Sci. Technol.* 1996, 40, pp. 94–103.

Problem to be Solved

As noted above, thermographic and photothermographic materials generally include a source of reducible silver ions for thermal development. The most common sources of reducible silver ions are the silver fatty acid carboxylates described above. Other components in such materials include a reducing agent system that usually includes a reducing agent, and optionally a toning agent in photothermographic materials (common ones being phthalazine and derivatives thereof) in one or more binders (usually hydrophobic binders). These components are generally formulated for coating using polar organic solvents.

We have found that by-products, including various fatty carboxylic acids (such as behenic acid), are formed in the materials during thermal development. These fatty acid by-products as well as the reducing agent and any toner that is present can readily diffuse out of the materials during thermal development and cause debris build-up on the thermal processing equipment (such as processor drums). This may result in the processed materials sticking to the processing equipment and causing a jam in the machine, as well as scratching of the outer surface of the developed materials.

It is known from U.S. Pat. No. 5,422,234 (Bauer et al.) and U.S. Pat. No. 5,989,796 (Moon) to use a surface overcoat layer in photothermographic materials to minimize the problems noted above. This overcoat layer comprises gelatin, poly(vinyl alcohol), poly(silicic acid) or combinations of such hydrophilic materials. While these overcoat layer materials provide suitable barriers to diffusion of reagents from the photothermographic materials, they are typically coated from water. Coating a separate hydrophilic layer from water when the imaging layer(s) are generally coated from polar organic solvents is not desirable for a number of reasons.

While polyacrylates and cellulosic materials can also be used as barrier layer materials to provide physical protection, they do not adequately prohibit diffusion of all by-products of thermal development out of the thermographic and photothermographic materials.

Useful water-soluble barrier layer polymers, including water-soluble polyesters, are described in copending U.S. Ser. No. 09/728,416, filed Dec. 1, 2000 by Kenney, Skoug, Ishida, and Wallace, as useful in thermally-developable materials.

Additional useful film-forming barrier layer polymers are those having epoxy functionality as described in copending U.S. Ser. No. 09/729,256, filed Dec. 1, 2000 by Miller, Horch, Bauer, and Teegarden.

There remains a need for thermally developable materials that have additional suitable barrier layers that provide physical protection while inhibiting the diffusion of various chemicals out of the materials during thermal development. It would be particularly desirable to have improved thermographic and photothermographic materials that include a layer that acts as a barrier to the diffusion of fatty acids from materials during thermal development.

SUMMARY OF THE INVENTION

The problems noted above are solved with a thermally developable material comprising a support having thereon:

a) one or more thermally developable, imaging layers comprising a binder and in reactive association, a non-photosensitive source of reducible silver ions and a reducing composition for the non-photosensitive source of reducible silver ions, and b) a barrier layer that is on the same side of but farther from the support than the one or more imaging layers, the barrier layer comprising a film-forming, water-insoluble aromatic polyester having a molecular weight of at least 10,000 g/mole and a glass transition temperature greater than 150° C.

This invention also provides a black-and-white photothermographic material comprising a support having thereon:

a) one or more thermally developable imaging layers comprising a binder and in reactive association, a photocatalyst, a non-photosensitive source of reducible silver ions, and a reducing composition for the non-photosensitive source of reducible silver ions, and b) a barrier layer that is on the same side of but farther from the support than the one or more imaging layers, the barrier layer comprising a film-forming, water-insoluble aromatic polyester having a molecular weight of at least 10,000 g/mole and a glass transition temperature greater than 150° C.

Further, a method of this invention for forming a visible image comprises:

A) imagewise exposing the black-and-white photothermographic material described above to electromagnetic radiation to form a latent image, and B) simultaneously or sequentially, heating the exposed photothermographic material to develop the latent image into a visible image.

In some embodiments, the photothermographic material has a transparent support and the imaging method of this invention further includes:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide a visible image in the imageable material.

The thermographic materials of this invention can also be used to provide a desired black-and-white image by imagewise heating and development using suitable imaging/development means and conditions.

It has been found that the particular barrier layer used in the present invention effectively inhibits the diffusion of fatty acids and other chemicals (such as developers and toners) from thermally developable imaging materials. Thus, the barrier layer reduces the buildup of debris on the processing equipment and improves imaging efficiencies and quality. The barrier layer can be the outermost layer and therefore also serve as an overcoat layer for the photothermographic material. Alternatively, the barrier layer can be interposed between the imaging layers) and an overcoat layer.

These advantages are achieved by using certain film-forming, water-insoluble aromatic polyesters in the barrier layer. These polymers can also be used in admixture with other film-forming polymers, and the combined formulation is believed to provide an excellent chemical and/or physical barrier to the fatty acids and other mobile chemicals.

DETAILED DESCRIPTION OF THE INVENTION

The thermographic and photothermographic materials of this invention can be used, for example, in conventional black-and-white thermography and photothermography, in electronically generated black-and-white hardcopy recording, in the graphic arts area (for example imagesetting, and phototypesetting), in the manufacture of printing plates, in microfilm applications and in radiographic imaging. Furthermore, the absorbance of these photothermographic materials between 350 and 450 nm is desirably low to permit their use in graphic arts applications such as contact printing, proofing, and duplicating ("duping").

The remaining disclosure will be directed to the preferred photothermographic materials, but it would be readily apparent that such materials can be readily modified to act as thermographic materials and used under thermographic imaging conditions known in the art.

In the photothermographic materials of this invention, the components needed for imaging can be in one or more layers. The layer(s) that contain the photosensitive photocatalyst (such as photosensitive silver halide), non-photosensitive source of reducible silver ions, or both, are referred to herein as imaging layer(s) or photothermographic emulsion layer(s). The photocatalyst and the non-photosensitive source of reducible silver ions are in catalytic proximity (or reactive association) and preferably are in the same layer. The materials are generally sensitive to radiation of from about 300 to about 850 nm.

Various layers are usually disposed on the "backside" (non-emulsion side) of the materials, including antihalation layer(s), protective layers, conducting layers, transport enabling layers, primer or subbing layers, and antistatic layers.

Various layers are also disposed on the "frontside" or emulsion side of the support including the barrier layer described herein, interlayers, opacifying layers, protective overcoat layers, antistatic layers, acutance layers, conducting layers, subbing or primer layers, auxiliary layers, and other layers readily apparent to one skilled in the art.

The present invention also provides a process for the formation of a visible image (usually a black-and-white image) by first exposing to suitable electromagnetic radiation and thereafter heating the inventive photothermographic material. Thus, in one embodiment, the present invention provides a process comprising:

A) imagewise exposing the photothermographic material of this invention to electromagnetic radiation to which the photocatalyst (for example a photosensitive silver halide) of the material is sensitive, to generate a latent image, and B) simultaneously or sequentially, heating the exposed material to develop the latent image into a visible black-and-white image.

This visible image can also be used as a mask for exposure of other photosensitive imageable materials, such as graphic arts films, proofing films, printing plates and circuit board films, that are sensitive to suitable imaging radiation (for example UV radiation). This can be done by imaging an imageable material (such as a photopolymer, a diazo material, a photoresist, or a photosensitive printing plate through the exposed and heat-developed photothermographic material of this invention using steps C and D noted above.

For thermographic imaging, imaging is carried out entirely with thermal energy from a suitable thermal imaging source.

When the photothermographic materials of this invention are heat-developed as described below in a substantially water-free condition after, or simultaneously with, imagewise exposure, a silver image is obtained. The photothermographic material may be exposed in step A with ultraviolet, visible, infrared, or laser radiation using an infrared laser, a laser diode, an infrared laser diode, a light-emitting diode, a light-emitting screen, a CRT tube, or any other radiation source readily apparent to one skilled in the art.

Definitions

As used herein:

In the descriptions of the photothermographic materials of the present invention, "a" or "an" component refers to "at least one" of that component. For example, the chemical materials (including polymers) described herein for the barrier layer can be used individually or in mixtures.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, protective layers, surface barrier layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Thermographic material(s)" are similarly defined except that no photosensitive photocatalyst is intentionally present in the imaging layers.

"Emulsion layer," "imaging layer," or "photothermographic emulsion layer" means a layer of a photothermographic material that contains the photosensitive silver halide and/or non-photosensitive source of reducible silver ions. Similarly, "thermographic emulsion layer," means a layer of a thermographic material that contains the non-photosensitive source of reducible silver ions. These layers are usually on what is known as the "frontside" of the support.

"Ultraviolet region of the spectrum" means that region of the spectrum less than or equal to 410 nm, preferably from about 100 nm to about 410 nm although parts of these ranges may be visible to the naked human eye. More preferably, the ultraviolet region of the spectrum is the region of from about 190 nm to about 405 nm.

"Visible region of the spectrum" refers to that region of the spectrum of from about 400 nm to about 750 nm.

"Short wavelength visible region of the spectrum" refers to that region of the spectrum from about 400 nm to about 450 nm.

"Red region of the spectrum" refers to that region of the spectrum of from about 600 nm to about 750 nm.

"Infrared region of the spectrum" refers to that region of the spectrum of from about 750 nm to about 1400 nm.

"Non-photosensitive" means not intentionally light sensitive.

"Transparent" means capable of transmitting visible light or imaging radiation without appreciable scattering or absorption.

As is well understood in this area, substitution is not only tolerated, but is often advisable and substitution is anticipated on the compounds (including polymers) used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where there is a benzene ring structure shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. For example, the term "alkyl group" is intended to include not only pure hydrocarbon alkyl chains (such as methyl, ethyl, propyl, t-butyl, cyclohexyl, iso-octyl, and octadecyl) but also ally chains bearing substituents known in the art, such as hydroxyl, alkoxy, thioalkyl, phenyl, halogen atoms (F, Cl, Br, and I), cyano, nitro, amino, and carboxy. Further, alkyl group includes ether and thioether groups (for example $CH_3$—$CH_2$—$CH_2$—O—$CH_2$—), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would of course be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24$^{th}$ Street, New York, N.Y. 10011).

Other aspects, advantages, and benefits of the present invention are apparent from the detailed description, examples, and claims provided in this application.

Barrier Layer

The advantages of the present invention are achieved by using certain film-forming aromatic polyesters in a barrier layer. The barrier layer can be the outermost layer on the "frontside" of the thermographic and photothermographic materials of this invention. A single homogeneous (that is, uniform throughout) barrier layer is preferred. However, as used herein, "barrier layer" also includes the use of multiple layers containing the same or different polyester composition disposed over the imaging and other layers to provide a barrier layer "structure" having multiple strata that serve as "barriers" to the diffusion of the various chemical components present in the material or produced during thermal development.

The barrier layer can also act as a protective overcoat, but in some embodiments, a protective layer is interposed between it and underlying imaging layers. In other embodiments, a protective layer can be interposed between the barrier layer and the underlying imaging layers. The barrier layer is generally transparent and colorless. If it is not transparent and colorless, it must be at least transparent to the wavelength of radiation used to provide and view the resulting image. The barrier layer does not significantly adversely affect the imaging properties of the thermographic and photothermographic materials of this invention, such as the sensitometric properties including minimum density, maximum density and photospeed. That is, haze is desirably as low as possible.

The optimum barrier layer dry thickness depends upon various factors including type of imaging material, thermal processing means, desired image and various imaging components. Generally, the barrier layer has a dry thickness of at least 0.2 $\mu$m, and preferably a dry thickness of from about 1.5 to about 3 $\mu$m. The upper limit to the dry thickness is dependent only upon what is practical for meeting imaging needs.

The barrier layer useful in this invention comprises one or more film-forming aromatic polyesters that have a glass transition temperature of at least 150° C., preferably of at least 170° C., and more preferably of at least 190° C. Generally, the glass transition temperature is below 300° C. These polyesters can also be mixed with one or more additional film-forming polymers that are different. The various film-forming polymers used in this layer must be compatible with each other so that a clear, non-hazy film is provided in a given layer. Mixtures of the various types of film-forming polymers can also be used. By "film-forming" is meant that the polymers provide such a smooth film at temperatures below 300° C.

The film-forming polyesters can be prepared using conventional procedures and starting materials that would be readily apparent to one skilled in the polymer chemistry art. The molecular weight of the useful film-forming polymers is generally at least 10,000 g/mole, and preferably the molecular weight is at least 20,000 g/mole and up to 250,000 g/mole.

The aromatic polyesters useful in the practice of this invention are generally water-insoluble, meaning that they are more soluble in polar organic solvents such as alcohols, ketones such as cyclohexanone and methyl ethyl ketone (MEK), chlorinated hydrocarbons such as dichloromethane, esters such as methyl acetate, ethyl acetate, and butyl acetate, and tetrahydrofuran, than water.

Aromatic polyesters that are useful in the practice of this invention can vary widely in structure and composition. In one embodiments, they include polycarbonates that are the reaction products of phosgene or carbonic acid chloride and a dihydroxyphenol compound.

More particularly, the film-forming aromatic polyesters useful in this invention are those polymers formed by the reaction of one or more dibasic aromatic acids and one or more dihydroxyphenol compounds.

For example, dibasic aromatic acids can be illustrated by the following generic Structure I:

I

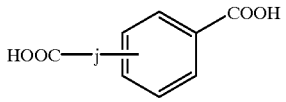

wherein j represents: (1) an optional linking group positioned meta or para to the carboxyl group on the phenyl ring, or (2) the atoms necessary to form a 5- or 6-membered fused carbocyclic or heterocyclic ring between any two adjacent carbon atoms of the phenyl ring.

For example, j can be one of the following divalent groups:

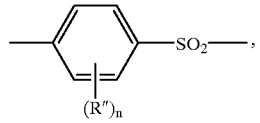

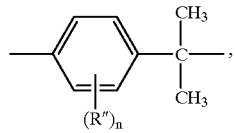

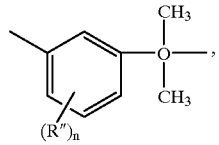

and

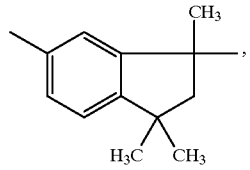

or represent a 5- or 6-membered fused carbocyclic or heterocyclic ring that provides the following dibasic aromatic acid structures:

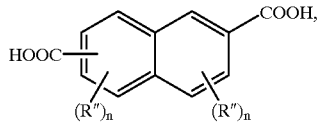

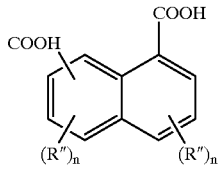

and

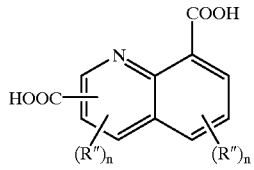

wherein R" is a halo group, a substituted or unsubstituted alkyl group having 1 to 10 carbon atoms (such as methyl, ethyl, iso-propyl, t-butyl, n-hexyl, and benzyl), a substituted or unsubstituted alkoxy group having 1 to 10 carbon atoms, (such as methoxy, ethoxy, iso-propoxy, phenylmethoxy, and n-hexoxy), or a substituted or unsubstituted carbocyclic or heterocyclic aryl group having 6 to 10 atoms in the aromatic ring system (including fused rings systems, such as phenyl, naphthyl, pyridyl, and phenylindane), and n is 0 or an integer up to 4.

Preferably, R" is a chloro group, a substituted or unsubstituted methyl group having up to 3 carbon atoms, a substituted or unsubstituted alkoxy group having up to 3 carbon atoms, or a substituted or unsubstituted phenyl group, and n is 0, 1 or 2.

Representative dibasic aromatic acids include, but are not limited to, terephthalic acid, isophthalic acid, 2,5-dimethylterephthalic acid, 2,5-dibromoterephthalic acid, bis(4-carboxyphenyl)sulfone, 1,1,3-trimethyl-3-(4-carboxyphenyl)-5-indanecarboxylic acid, 2,6-naphthalenedicarboxylic acid, and 2,2,-bis(4-carboxyphenyl)propane. Mixtures of these dibasic acids, in any proportions, can also be used. For example, a blend of terephthalic acid and isophthalic acid is particularly useful. It is also possible to use chemical equivalents of the dibasic acids, such as the mixed anhydride/acids, dianhydrides, mixed acid/esters, diesters, mixed ester/acids, and mixed ester/anhydrides, but the dibasic acids are preferred.

The dihydroxyphenol compounds used to react with the dibasic aromatic acids can be illustrated by the following Structure IIa or IIb:

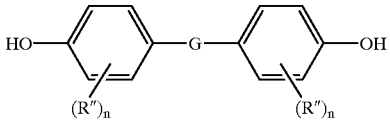

IIa

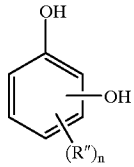

IIb wherein G is a linking group positioned meta or para to each phenolic hydroxy group. For example, representative G groups include, but are not limited to, the following divalent groups:

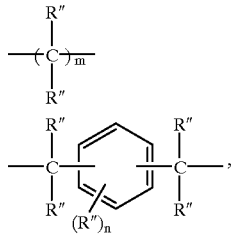

-continued

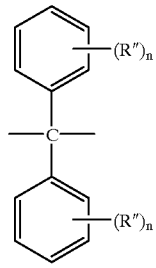

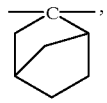

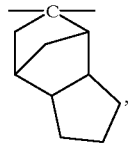

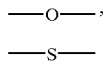

and

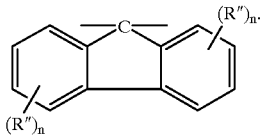

R" is as defined above for the dibasic aromatic acids, n' is 0 or an integer up to 4, and m is an integer of from 1 to 6.

Representative dihydroxyphenol compounds useful in preparing the aromatic polyesters useful in this invention include, but are not limited to, 4,4'-(hexafluoroisopropylidene) diphenol (bisphenol AF), 4,4'-isopropylidenediphenol (bisphenol A), 4,4'-isopropylidene-2,2',6,6'-tetrachlorobisphenol, 4,4'-isopropylidene-2,2',6,6'-tetrabromobisphenol, 4,4'-(hexahydro-4,7-methanoinden-5-ylidene) bisphenol, 4,4'-(hexahydro-4,7-methanoinden-5-ylidene) bisphenol, 4,4'- 2-norbomylidene) bisphenol, 9,9-bis(4-(hydroxyphenol) fluorene, bis(4-hydroxyphenyl) diphenol methane, 1,4-bis(p-hydroxycumyl)benzene, 1,3-bis(p-hydroxycumyl)benzene, 4,4'-oxybisphenol, hydroxyquinone, and resorcinol. The preferred dihydroxyphenol compound is 4,4'-(hexafluoroisopropylidene) diphenol (Bisphenol AF). Mixtures of dihydroxyphenol compounds can be used also.

The most preferred aromatic polyesters useful in the practice of this invention are the following compounds, shown with their glass transition temperatures.

| Polyester | Structure | Tg (° C.) |
|---|---|---|
| 1 | 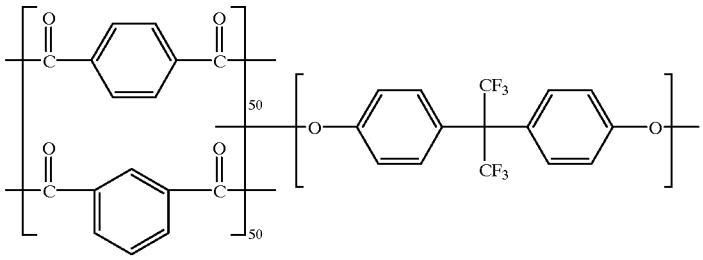 | 223 |
| 2 | 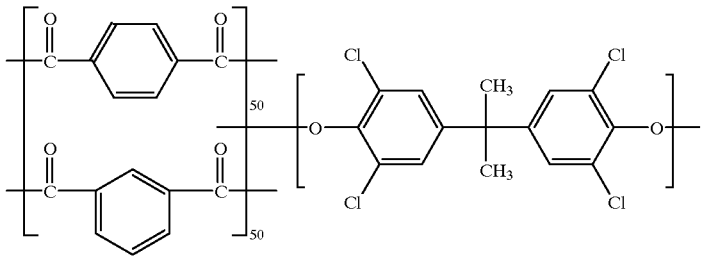 | 231 |
| 3 | 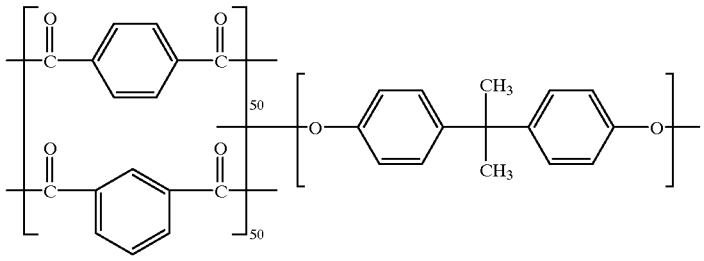 | 170 |
| 4 | 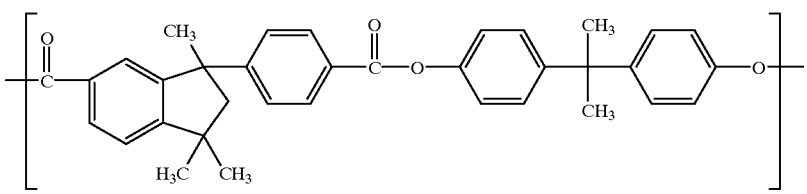 | 247 |
| 5 | 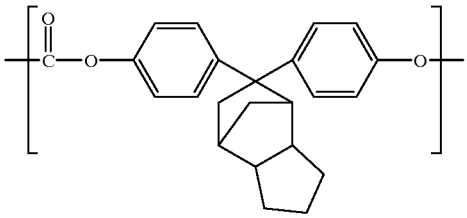 | 229 |
| 6 | 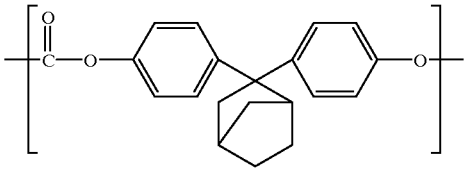 | 222 |
The aromatic polyesters useful in this invention can be prepared using any suitable or conventional procedure known for using the noted reactants. For example, a useful procedure is provided by P. W. Morgan in *Condensation Polymers: By Interfacial and Solution Methods*, Interscience, New York, N.Y., 1965.

Additional film-forming polymers can also be present in the barrier layer mixed with the aromatic polyesters. These additional polymers can be of any structure or composition as long as they are film-forming (as defmed above), compatible with the aromatic polyesters, provide scratch-resistant films, and are stable as thermal development temperatures and conditions. Such polymers can be cellulosic materials, polyacrylates (including copolymers), polymethacrylates (including copolymers), non-aromatic polyesters, and polyurethanes. When such additional polymers are present in the barrier layer used in this invention, they are present in an amount of up to 50 weight %, based on total dry barrier layer weight. Thus, the film-forming aromatic polyesters generally comprise from about 50 to about 100 weight %, based on total dry barrier layer weight, of the barrier layer.

The barrier layers can also include various addenda such as surfactants, lubricants, matting agents, crosslinking agents, photothermographic toners, acutance dyes and other chemicals that would be readily apparent to one skilled in the art depending upon whether the material is a photothermographic or thermographic material. These components can be present in conventional amounts.

The barrier layers can be applied to other layers in the thermographic or photothermographic materials using any suitable technique (see coating described below). Generally, the components of the layers are formulated and coated out of predominantly one or more suitable polar organic solvents such as methyl ethyl ketone, acetone, tetrahydrofuran, methanol and mixtures thereof at from about 2 to about 35% solids, coated in a suitable fashion, and dried.

Alternatively, the barrier layer(s) can be formulated in and coated as an aqueous formulation wherein water comprises less than 50 weight % of the total amount of solvents, the rest being one or more polar organic solvents are described above. Components of the layer(s) can be dissolved or dispersed within such coating formulations using known procedures.

The Photocatalyst

As noted above, the photothermographic materials of the present invention include one or more photocatalysts in the photothermographic emulsion layer(s). Useful photocatalysts include, but are not limited to, silver halides, titanium oxide, cupric salts [such as copper (II) salts)], zinc oxide, cadmium sulfide, and other photocatalysts that would be readily apparent to one skilled in the art.

Preferred photocatalysts are photosensitive silver halides such as silver bromide, silver iodide, silver chloride, silver bromoiodide, silver chloro-bromoiodide, silver chlorobromide, and others readily apparent to one skilled in the art. Mixtures of various types of silver halides can also be used in any suitable proportion. Silver bromide and silver bromoiodide are more preferred, the latter silver halide including up to 10 mol % silver iodide.

The shape of the photosensitive silver halide grains used in the present invention is in no way limited. The silver halide grains may have any crystalline habit including, but not limited to, cubic, octahedral, tetrahedral, dodecahedral, other polyhedral, rhombic, orthorhombic, tabular, laminar, twinned, and platelet morphologies. If desired, a mixture of these crystals may be employed. Silver halide grains having cubic or tabular morphology are preferred.

The silver halide grains may have a uniform ratio of halide throughout. They may have a graded halide content, with a continuously varying ratio of, for example, silver bromide and silver iodide or they may be of the core-shell-type, having a discrete core of one halide ratio, and a discrete shell of another halide ratio. Core-shell silver halide grains useful in photothermographic materials and methods of preparing these materials are described for example, in U.S. Pat. No. 5,382,504 (Shor et al.). Iridium and/or copper doped core-shell grains of this type are described in U.S. Pat. No. 5,434,043 (Zou et al.), U.S. Pat. No. 5,939,249 (Zou), and EP-A-0 627 660 (Shor et al.), all incorporated herein by reference.

The photocatalyst can be added to or formed within the emulsion layer(s) in any fashion as long as it is placed in catalytic proximity to the non-photosensitive source of reducible silver ions.

For the preferred photocatalysts, it is preferred that the silver halide be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ prepared silver halide. In this process, the source of reducible silver ions, such as a long chain fatty acid silver carboxylate (commonly referred to as a silver "soap") is formed in the presence of the preformed silver halide grains. Co-precipitation of the reducible source of silver ions in the presence of silver halide provides a more intimate mixture of the two materials [see, for example, U.S. Pat. No. 3,839,049 (Simons)]. Materials of this type are often referred to as "preformed soaps."

The silver halide grains used in the imaging formulations can vary in average diameter of up to several micrometers (em) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized, such lower limit, for example being about 0.01 or 0.005 $\mu$m.

The average size of the photosensitive doped silver halide grains is expressed by the average diameter if the grains are spherical and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland) 1955, pp. 94–122, and in C. E. K. Mees and T. H. James, *The Theory of the Photographic Process*, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by chill setting and leaching or the emulsion can be coagulation washed [for example by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.) and by ultrafiltration to remove soluble salts.

It is also effective to use an in situ process in which an organic or inorganic halide-containing compound is added to an organic silver salt to partially convert the silver of the organic silver salt to silver halide. The halide-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76 and 17216/75

The one or more light-sensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

Chemical and Spectral Sensitizers

The photosensitive silver halides used in the invention may be may be employed without modification. However, they are preferably chemically and/or spectrally sensitized in a manner similar to that used to sensitize conventional wet-processed silver halide photographic materials or state-of-the-art heat-developable photothermographic materials.

For example, the photothermographic material may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in T. H. James, *The Theory of the Photographic Process*, Fourth Edition, Chapter 5, pp. 149 –169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh), and U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915 371 (Lok et al.).

One method of chemical sensitization is by oxidative decomposition of a spectral sensitizing dye in the presence of a photothermographic emulsion, as described in U.S. Pat. No. 5,891,615 (Winslow et al.) incorporated herein by reference.

Sulfur-containing chemical sensitizers useful in the present invention are well known in the art and described for example, in Sheppard et al., *J Franklin Inst.*, 1923, 196, pp. 653 and 673, C. E. K. Mees and T. H. James, *The Theory of the Photographic Process*, Fourth Edition, 1977, pp. 152–3, Tani, T., *Photographic Sensitivity: Theory and Mechanisms*, Oxford University Press, NY, 1995, pp. 167–176, U.S. Pat. No. 5,891,615 (Winslow et al.), Zavlin et al., IS&T's 48$^{th}$ Annual Conference Papers, May 7–11 1995 Washington D.C., pp. 156–6), U.S. Pat. No. 4,810,626 (Burgmaier et al.), U.S. Pat. No. 4,036,650 (Kobayashi et al.), U.S. Pat. No. 4,213,784 (Ikenoue et al.), and U.S. Pat. No. 4,207,108 (Hiller).

Particularly useful sulfur-containing chemical sensitizers are substituted thiourea ligands that include any —S═C(—N<)N< group that has one or more of the four nitrogen valences substituted with hydrogen or with the same or different aliphatic substituents. More preferably, the four nitrogen valences are substituted with the same aliphatic substituent. Such useful thioureas are described for example in U.S. Pat. No. 5,843,632 (Eshelman et al.) and in copending and commonly assigned U.S. Ser. No. 09/667,748 (filed Sep. 21, 2000 by Lynch, Simpson, Shor, Willett, and Zou), incorporated herein by reference.

Particularly, useful tellurium-containing chemical sensitizing compounds are described in copending and commonly assigned U.S. Ser. No. 09/746,400 (filed Dec. 21, 2000 by Lynch, Opatz, Shor, Simpson, Willett, and Gysling), incorporated herein by reference.

Useful combinations of sulfur-or tellurium-containing chemical sensitizers with gold(III) chemical sensitizers are described in copending and commonly assigned U.S. Ser. No. 09/768,094 (filed Jan. 24,2001 by Simpson, Whitcomb, and Shor), incorporated herein by reference.

The total amount of chemical sensitizers that may be used during formulation of the imaging composition will generally vary depending upon the average size of silver halide grains. The total amount is generally at least $10^{31\ 10}$ mole per mole of total silver, and preferably from $10^{31\ 8}$ to about $10^{31\ 2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary would be readily determinable by one of ordinary skill in the art.

In general, it may also be desirable to add spectral sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.) are effective in the practice of the invention.

An appropriate amount of spectral sensitizing dye added is generally about $10^{-10}$ to $10^{31\ 1}$ mole, and preferably, about $10^{-7}$ to $10^{-2}$ mole per mole of silver halide.

To further control the properties of photothermographic materials, (for example, contrast, $D_{min}$, speed, or fog), it may be preferable to add one or more heteroaromatic mercapto compounds or heteroaromatic disulfide compounds as "supersensitizers". Examples include compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. Many of the above compounds are described in EP-A-0 559 228 (Philip Jr. et al.) as supersensitizers for infrared photothermographic materials.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

Non-Photosensitive Source of Reducible Silver Ions

The non-photosensitive source of reducible silver ions used in photothernographic materials of this invention can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferred examples of the silver salts of aromatic carboxylic acid and other carboxylic acid group-containing compounds include, but are not limited to, silver benzoates, a silver-substituted benzoate, such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl 4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the α-(on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate fill soap, containing not more than about 15% of free carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Non-photosensitive sources of reducible silver ions can also provided as core-shell silver salts such as those described in commonly assigned and copending U.S. Ser. No. 09/761,954 (filed Jan. 17, 2001 by Whitcomb and Pham), incorporated herein by reference. These silver salts include a core comprised of one or more silver salts and a shell having one or more different silver salts.

The photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mo/m^2$ of the dry photothermographic material, and preferably from about 0.01 to about 0.05 $mol/m^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat No. 6,020,117 (Bauer et al.).

In some instances, the reducing agent composition comprises two or more components such as a hindered phenol developer and a co-developer that can be chosen from the various classes of reducing agents described below. Temary developer mixtures involving the further addition of contrast enhancing agents are also useful. Such contrast enhancing agents can be chosen from the various classes described below.

Hindered phenol reducing agents are preferred (alone or in combination with one or more co-developers and contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis (hydroxyphenyl)methanes, hindered phenols, and hindered naphthols each of which may be variously substituted.

Representative binaphthols include, but are not limited, to 1,1 '-bi-2-naphthol, 1,1 '-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1 -bis(2-hydroxy-3,5-dimethylphenyl)-3,5,5-trimethylhexane (NONOX or PERMANAX WSO), 1,1 -bis(3,5-di-t-butyl 4-hydroxyphenyl)methane, 2,2-bis(4-hydroxy-3-methylphenyl)propane, 4,4-ethylidene-bis(2-t-butyl-6-methylphenol), 2,2'-isobutylidene-bis(4,6-dimethylphenol) (LOWINOX 221 B46), and 2,2-bis(3,5-dimethyl 4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxyl amine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamidophenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1 4-dihydropyridine), bisphenols [such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol) and 2,2-bis(3,5-dimethyl-4-hydroxyphenyl)propane], ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.).

Useful co-developer reducing agents can also be used as described for example, in copending U.S. Ser. No. 09/239, 182 (filed Jan. 28, 1999 by Lynch and Skoog), incorporated herein by reference. Examples of these compounds include, but are not limited to, 2,5-dioxo-cyclopentane carboxaldehyde, 5-(hydroxymethylene)-2,2-dimethyl-1,3-dioxane-4,6-dione, 5-(hydroxymethylene)-1,3-dialkylbarbituric acids, 2-(ethoxymethylene)-1H-indene-1,3 (2H)-dione.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Still other useful co-developers include 2,5-dioxo-cyclopentane carboxaldehydes, 5-(hydroxymethylene)-1,3-dialkyl-barbituric acids, and 2-(ethoxymethylene)-1 H-indene-1,3(2H)-diones. Additional developers are described in U.S. Pat. No. 6,100,022 (Inoue et al.). All of the above patents are incorporated herein by reference.

Yet another class of co-developers are substituted acrylonitrile compounds that can be represented by structure III as follows:

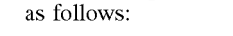

$$H(R')C{=}C(R)CN \qquad \text{III}$$

wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halo atom, cyano group, carboxy group, ester group and phenylsulfonyl group). R' is a halo group (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quaternary ring nitrogen atom (such as pyridyl, furyl, diazolyl, triazolyl, pyrrolyl, tetrazolyl, benzotriazolyl, benzopyrrolyl, and quinolinyl groups). Further details of these compounds and their preparation can be found in U.S. Pat. No. 5,635,339 (Murray) and U.S. Pat. No. 5,545,515 (Murray et al.), both incorporated herein by reference.

Examples of such compounds include, but are not limited to, the compounds identified as HET-01 and HET-02 in U.S. Pat. No. 5,635,339 (noted above) and CN-01 through CN-13 in U.S. Pat. No. 5,654,130 (noted above). Particularly useful compounds of this type are (hydroxymethylene) cyanoacetates and their metal salts.

Various contrast enhancers can be used in some materials with specific co-developers. Examples of useful contrast enhancers include, but are not limited to, hydroxylamines (including hydroxylamine and alkyl- and aryl-substituted derivatives thereof, alkanolamines and amimonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the above patents are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Other Addenda

The thermographic and photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damsbroder), and 2-(tribromo-methylsulfonyl) quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobrornide perbromide) as described, for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600,589 (Philip, Jr. et al.) and EP-A-0 600,586 (Philip, Jr. et al.), and tribromomethylketones as described, for example, in EP-A-0 600,587 (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the thermographic and photothermographic emulsion layer or in an adjacent layer. Toners are well known materials in the thermographic and photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.), and GB 1,439,478 (AGFA-GEVAERT).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbarnoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference] are particularly useful toners.

Binders

The photocatalyst (such as photosensitive silver halide), when used, the non-photosensitive source of reducible silver ions, the reducing agent composition, and any other additives used in the present invention are generally added to one or more binders that are either hydrophilic or hydrophobic. Thus, either aqueous or solvent-based formulations can be used to prepare the thermographic and photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Examples of useful hydrophilic binders include, but are not limited to, gelatin and gelatin-like derivatives (hardened or unhardened), cellulosic materials such as cellulose acetate, cellulose acetate butyrate, hydroxymethyl cellulose, acrylamide/methacrylamide polymers, acrylic/methacrylic polymers polyvinyl pyrrolidones, polyvinyl acetates, polyvinyl alcohols, and polysaccharides (such as dextrans and starch ethers).

Hardeners for various binders may be present if desired. Useful hardeners are well known and include diisocyanate compounds as described for example in EP-0 600 586B1 and vinyl sulfone compounds as described in EP-0 600 589B1.

Where the proportions and activities of the thermographic and photothermographic materials require a particular developing time and temperature, the binder(s) should be able to withstand those conditions. Generally, it is preferred that the binder not decompose or lose its structural integrity at 120° C. for 60 seconds. It is more preferred that it not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The thermographic and photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 18431. A method of making dimensionally stable polyester films is described in *Research Disclosure*, September, 1999, item 42536.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Thermographic and Photothermographic Formulations

The formulation for the emulsion layer(s) can be prepared by dissolving and dispersing the binder, the photocatalyst (for photothennographic materials), the non-photosensitive source of reducible silver ions, the reducing composition, and optional addenda in an organic solvent, such as toluene, 2-butanone, acetone or tetrahydrofuran.

Alternatively, these components can be formulated with a hydrophilic binder in water or water-organic solvent mixtures to provide aqueous-based coating formulations.

Thermographic and photothermographic materials can also contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The thermographic and photothermographic materials can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The thermographic and photothermographic materials can be constructed of one or more layers on a support. Single layer materials should contain the photocatalyst (for photothermographic materials), the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Thermographic and photothermographic formulations described can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in copending and commonly assigned U.S. Ser. No. 09/510,648 (filed Feb. 23, 2000 by Ludemann, LaBelle, Geisler, Warren, Crump, and Bhave).

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers. A backside antihalation layer is essential to the present invention and is composed of a heat-bleachable composition of the present invention as described below.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes particularly useful as antihalation and acutance dyes include dihydroperimidine squaraine dyes having the nucleus represented by the following general Structure IV:

IV

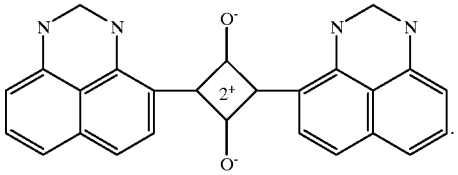

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis [[1 -oxohexyl)oxy]methyl]-1H-perimidin-4-yl]-2,4-dihydroxy-, bis(inner salt).

Dyes particularly useful as antihalation dyes in a backside layer of the photothermographic material also include indolenine cyanine dyes having the nucleus represented by the following general Structure V:

V

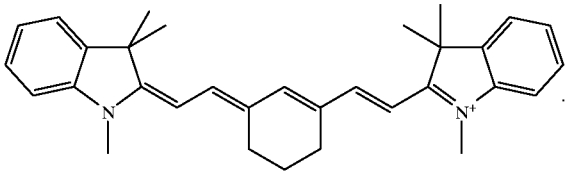

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1, 3-dihydro-1,3,3-trimethyl-2H-indol-2-ylidene)ethylidene]-5-methyl-1 -cyclohexen-1-yl]ethenyl]-1,3,3-trimethyl-, perchlorate.

It is also useful in the present invention to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Imaging/Development

While the imaging materials of the present invention can be imaged in any suitable manner consistent with the type of material using any suitable imaging source (typically some type of heat, radiation or electronic signal), the following discussion will be directed to the preferred imaging means for photothermographic materials. Generally, such materials are sensitive to radiation in the range of from about 300 to about 850 nm.

Imaging of photothermographic materials can be achieved by exposing the materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, Vol. 389, Publication 38957, September 1996 (such as sunlight, xenon lamps, and fluorescent lamps). Particularly useful exposure means are laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C., and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent. The second heating step prevents further development.

When used in a thermographic element, the image may be developed merely by heating at the above noted temperatures using a thermal stylus or print head, or by heating while in contact with a heat absorbing material.

Thermographic elements of the invention may also include a dye to facilitate direct development by exposure to laser radiation. Preferably the dye is an infrared absorbing dye and the laser is a diode laser emitting in the infrared. Upon exposure to radiation the radiation absorbed by the dye is converted to heat that develops the thermographic element.

Use as a Photomask

The thermographic and photothermographic materials of the present invention are sufficiently transmissive in the range of from about 350 to about 450 nm in non-imaged areas to allow their use in a process where there is a subsequent exposure of an ultraviolet or short wavelength visible radiation sensitive imageable medium. For example, imaging the photothermographic material and subsequent heat development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as, a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The following examples are provided to illustrate the practice of this invention, and are not intended to be limiting in any manner. The examples provide exemplary synthetic procedures and preparatory procedures using the barrier layers described herein. Unless otherwise indicated, all materials are commercially available from one or more sources.

Materials and Methods for the Examples:

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRALOID™ A-21 and PARALOID™ A-21 are acrylic copolymers available from Rohm and Haas (Philadelphia, Pa.).

BUTVAR® B-79 is a polyvinyl butyral resin available from Solutia, Inc. (St. Louis, Mo.).

n-Butyl nickelate is tetrabutylammonium bis(cis-1,2-dicyano-1,2-ethenedithiolato)-nickelate(1−) and is available from H. W. Sands (Jupiter, Fla.).

CAB 171–15S is a cellulose acetate butyrate resin available from Eastman Chemical Co (Kingsport, Tenn.).

DESMODUR® N3300 is an aliphatic hexamethylene diisocyanate available from Bayer Plastic and Coatings (Pittsburgh, Pa.).

Gasil 23F is a Synthetic amorphous silicon dioxide available from Crosfield Chemicals (Joliet, Ill.).

LOWINOX 221B446 is 2,2'-isobutylidene-bis(4,6-dimethylphenol) and is available from Great Lakes Chemical.

MEK is methyl ethyl ketone (or 2-butanone).

PERMANAX WSO (or NONOX) is 1,1-bis(2-hydroxy-3,5-dimethylphenyl)-3,5,5-trimethylhexane [CAS RN=7292-140]and is available from St-Jean PhotoChemicals, Inc. (Quebec, Canada).

PIOLOFORM BS-16 is a polyvinyl butyral resin available from Wacker Polymer Systems (Adrian, Mich.).

PIOLOFORM BL-18 is a polyvinyl butyral resin available from Wacker Polymer Systems (Adrian, Mich.).

SYLYSIA 310 P is a synthetic amorphous silica available from Fuji Silysia.

SYLOID 74×6000 is a synthetic amorphous silica available from Grace Davison.

Vinyl Sulfone-1 (VS-1) is described in U.S. Pat. No. 6,143,487 and has the following structure:

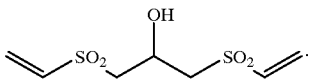

VITEL 2200 is a polyester resin available from Bostik, Inc. (Middleton, Mass).

EXAMPLES 1–6

Photothermographic materials were prepared using the following layer formulations and procedures.

Photothermographic Formulation:

This imaging formulation was prepared similarly to that described in U.S. Pat. No. 5,939,249 (Zou), incorporated herein by reference. The following TABLE I shows the components of this formulation, their formulation concentrations (% weight based on total formulation weight in methyl ethyl ketone), and dry coating coverage (g/m$^2$).

TABLE I

| Component | Formulation Concentration (% weight) | Coating Coverage (g/m$^2$) |
|---|---|---|
| Pioloform BS-18 polyvinyl butyral | 2.85 | 1.54 |
| AgBr preformed grains | 0.34 | 0.184 |
| Behenic acid | 0.52 | 0.281 |
| Arachidic acid | 0.37 | 0.201 |
| Stearic acid | 0.26 | 0.139 |
| Ag behenate | 7.44 | 4.03 |
| Ag arachidate | 5.10 | 2.77 |
| Ag stearate | 0.82 | 0.443 |
| Pyridinium hydrobromide perbromide | 0.08 | 0.043 |
| Zinc bromide | 0.08 | 0.042 |
| 2-Mercapto-5-methylbenzimidazole | 0.05 | 0.027 |
| 2-(4-chlorobenzoyl)-benzoic acid | 0.55 | 0.298 |
| Benzothiazolium, 3-ethyl-2-[[7-[[3-ethyl-5-(methylthio)-2(3H)-benzothiazolylidene]-methyl]-4,4a,5,6-tetrahydro-2(3H)-naphthalenylidene]methyl]-5-(methylthio)-, iodide | 0.002 | 0.001 |
| VITEL PE2200 polyester resin | 0.08 | 0.045 |
| Pioloform BL-16 polyvinyl butyral | 13.6 | 7.40 |
| 2-Tribromomethyl-sulfonylquinoline | 0.43 | 0.233 |
| DESMODUR | 0.22 | 0.119 |
| 2,2-Isobutylidene-bis(4,6-dimethylphenol) | 3.15 | 1.71 |
| Tetrachlorophthalic acid | 0.12 | 0.065 |
| Phthalazine | 0.44 | 0.239 |
| 4-Methylphthalic acid | 0.20 | 0.108 |

Carrier Layer Formulation:

A carrier layer coated underneath the photothermographic imaging formulation comprised the components and amounts shown in TABLE II below. Methyl ethyl ketone was the solvent.

TABLE II

| Component | Formulation Concentration (% weight) | Coating Coverage (g/m$^2$) |
|---|---|---|
| VITEL 2200 polyester | 0.274 | 0.012 |
| Pioloform BL-16 polyvinyl butyral | 6.57 | 0.296 |

Barrier Layer Formulation:

Barrier layer formulations contained the components and amounts shown in TABLE 111 below. Methyl ethyl ketone was the solvent.

TABLE III

| Component | Formulation Concentration (% weight) | Coating Coverage ($g/m^2$) |
|---|---|---|
| 1,3-Bis(vinylsulfonyl)-2-propanol | 0.091 | 0.056 |
| Benzotriazole | 0.068 | 0.042 |
| Sylysia 310 amorphous silica | 0.054 | 0.033 |
| Acryloid A 21 | 0.172 | 0.106 |
| Binder polymers, see TABLE V below | 4.464 | 2.75 |
| Cyclobutenediylium, 1,3-bis[2,3-dihydro-2,2-bis[[1-oxohexyl)oxy]methyl]-1H-perimidin-4-yl]-2,4-dihydroxy-, bis(inner salt) | 0.054 | 0.033 |
| Ethyl 2-cyano-3-oxobutanoate | 0.060 | 0.037 |

The photothermographic material of this invention was prepared by coating the noted carrier and photothennographic formulations under safelight conditions onto a 7 mil (178 $\mu$m) thick transparent poly(ethylene terephthalate) film provided with a backside antihalation layer containing a dye having an absorbance >1 at the imaging exposure wavelength, using conventional coating techniques and equipment. Once dried, the resulting imaging layer was overcoated with a barrier layer formulation (3.85 $g/m^2$ dry coverage). A Control A material was prepared by coating a topcoat formulation comprising solely cellulose acetate butyrate (CAB) as the binder material in methyl ethyl ketone (MEK) to provide a dry coverage of 3.85 $g/m^2$. This material was considered a "Control" film because the topcoat layer is not a barrier layer within the scope of the present invention.

Photothermographic materials of the present invention were prepared similarly except that over the defined imaging layer was coated a solution of the polyesters identified below (TABLE V) in the indicated solvent. The dry coverage (thickness) of the resulting barrier layers is shown in TABLE VI below.

TABLE V

| Polyester | Structure | Solvent | Tg (° C.) |
|---|---|---|---|
| 1 | 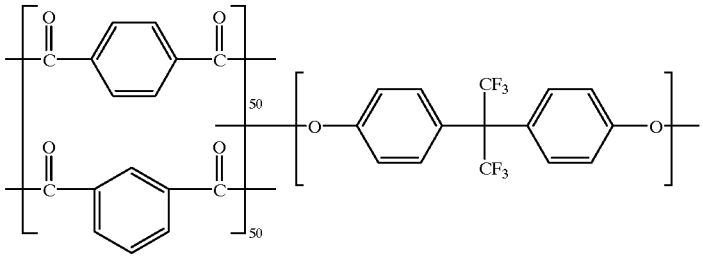 | Methyl ethyl ketone (MEK) | 223 |
| 2 | 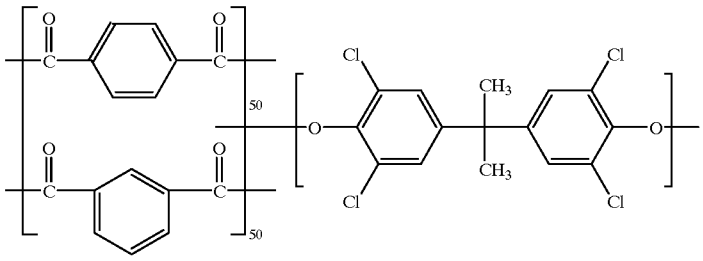 | 80:20 (v/v) MEK/Dichloro-methane (DCM) | 231 |
| 3 | 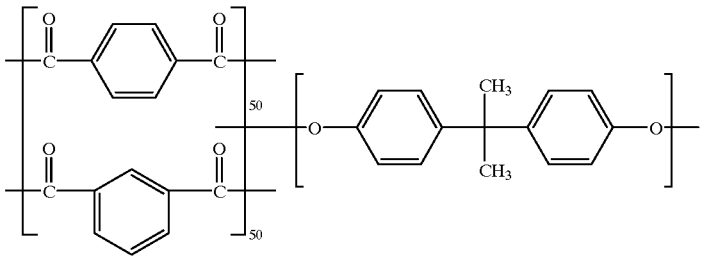 | DCM | 170 |

TABLE V-continued

| Polyester | Structure | Solvent | Tg (° C.) |
|---|---|---|---|
| 4 | 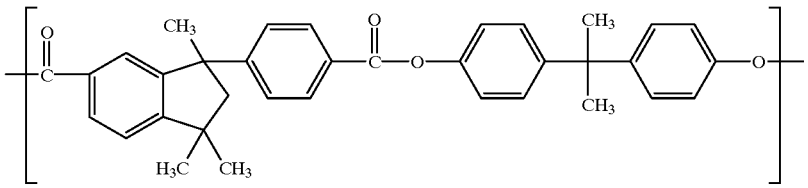 | 80:20 (v/v) MEK/DCM | 247 |
| 5 | 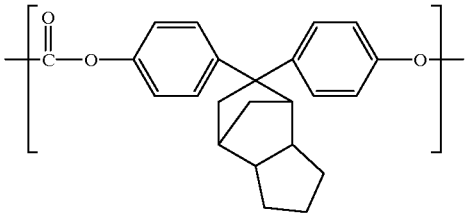 | 80:20 (v/v) MEK/DCM | 229 |
| 6 | 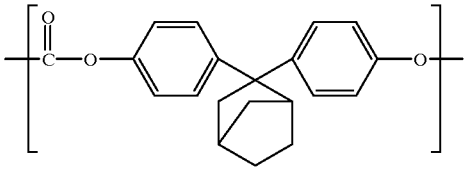 | 80:20 (v/v) MEK/DCM | 222 |

The effectiveness of the various barrier layers to inhibit the diffusion of chemical components (such as fatty acids like behenic acid) from the imaging layer was evaluated as follows. A sample of the photothennographic material was placed between clean conventional glass microscope slides. About 1110 g of weight was evenly applied to the resulting laminate while it was heated at 120° C. for 30 minutes. The glass slide in contact with the photothermographic material topcoat was then analyzed for the relative amount of fatty acid transferred to it using Attenuated Total Reflectance Fourier Transform InfraRed Spectroscopy (ATR FTIR) and a conventional Bio-Rad FTS60 FTIR spectrometer fitted with a diamond ATR stage. At least two spectra of the glass slide from each photothermographic material sample were collected. The $CH_2$ stretching bands (2920 and 2850 $cm^{-1}$) and the $CH_3$ stretching band (2955 $cm^{-1}$) of the fatty acid were divided by the $SiO_2$ band (910 $cm^{31\ 1}$) of the glass to provide a ratio after baseline correction. The relative amount of fatty acid transferred is directly related to the value of the ratio. That is, lower ratios mean lower fatty acid transfer and that the barrier layer acts as a better barrier layer. The FTIR ratios are also shown in TABLE VI below.

TABLE VI

| Material | Polyester | FTIR Ratio |
|---|---|---|
| Control A | None (CAB) | 0.017 |
| Example 1 | 1 | 0.015 |
| Example 2 | 2 | 0.007 |
| Example 3 | 3 | 0.005 |
| Example 4 | 4 | 0.002 |
| Example 5 | 5 | 0.005 |
| Example 6 | 6 | 0.004 |

EXAMPLE 7

Similar photothermographic materials were prepared as described in Examples 1–6 except the barrier layer formulations were coated to a dry coverage of 2.75 $g/m^2$. The Control A formulation was compared to a barrier layer comprising Polyester 1 as described in Example 1.

To evaluate each barrier layer, a sheet of cellulose acetate was placed over the barrier layer, and the materials were heat-developed using a conventional DRYVIEW™ 8700 Thermal Processor (122° C., 15 seconds). The cellulose acetate sheet was then removed and the chemicals that were transferred to it from the photothermographic material were extracted and analyzed by GC/MS. The results of these analyses are shown in TABLE VII below. The data show that the polyester barrier layer within the scope of the present invention more effectively inhibited transfer of phthalazine toner, LOWINOX reducing agent and fatty acids.

TABLE VII

| Material | Polyester | Phthalazine Transferred ($mg/m^2$) | LOWINOX Transferred ($mg/m^2$) | Fatty Acids Transferred ($mg/m^2$) |
|---|---|---|---|---|
| Control A | None (CAB) | 3.81 | 7.55 | 8.20 |
| Example 7 | 1 | 1.75 | 1.76 | 2.44 |

EXAMPLE 8

Polyester 1 was included in a formulation that provided a barrier layer for a photothermographic material that also included a potassium salt of ethyl(hydroxymethylene) cyanoacetate as a high contrast agent. The barrier layer was interposed between the imaging layer and topcoat.

Photothermographic Formulation:

An imaging formulation was prepared as follows:

A preformed soap homogenate (147.88 g at 28% solids, 1.3689% BUTVAR® B-79 polyvinyl butyral, 26.6311% preformed soap) was added to a glass jar. The dispersion was stirred at a constant rate of 500 rpm using a pitched blade impeller at 21° C. To this dispersion was added the following components in the noted order:

Pyridinium hydrobromide perbromide (1.632 g) in methanol (4.878 g), 0.868 g of solution, Zinc bromide (1.846 g) in methanol (4.940 g), 0.905 g of solution, BUTVAR® B-79 polyvinyl butyral (0.951 g), Sensitizing dye solution (10.471 g) containing 2-(p-chlorobenzoyl)-benzoic acid (14.889 g), 3-ethyl-2-[[7-[[3-ethyl-5-(methylthio)-2(3H)-benzothiazolylidene]methyl]-4,4a,5,6-tetrahydro-2(3H)-naphthalenylidene]-methyl]-5-(methylthio) benzothiazolium iodide sensitizing dye (0.051 g), MEK (15.696 g), methanol (47.027 g), and 2-mercapto-5-methylbenzimidazole (0.869 g).

BUTVAR® B-79 polyvinyl butyral (33.961 g) with stirring after cooling to 13° C., Antifoggant solution (19.584 g) containing 2-tribromomethyl-sulfonylquinoline (10.056 g) in 136.83 g of MEK, Solution (1.254 g) containing DESMODUR N3300 isocyanate hardening agent (3.152 g) in MEK (36.208 g), Solution (5.851 g) containing phthalazine (7.674 g) in MEK (36.208 g), Solution (1.146 g) containing tetrachlorophthalic acid (1.715 g) in MEK (3.439 g) and methanol (3.439 g), Solution (4.772 g) containing 4-methylphthalic acid (3.837 g) in methanol (3.002 g) and MEK (28.954 g), PERMANAX WSO phenol (10.239 g), and Solution (2.149 g) containing potassium salt of ethyl (hydroxymethylene)cyanoacetate (1.380 g) in methanol (14.738 g).

The photothermographic material of this invention was prepared by coating the noted photothermographic formulation onto a polyethylene terephthalate film support (4 mil, 102 μm) provided with a backside antihalation layer containing a dye having an absorbance >1 at the imaging exposure wavelength, using a knife coating apparatus. The coatings were dried for 2 minutes at 85° C.

Topcoat Formulation:

A topcoat formulation was prepared as follows:

A polymer solution containing MEK (184.37 g), methanol (24.114 g), cellulose acetate butyrate (CAB 171–15S, 33.773 g) and PARALOID A-21 acrylic polymer (1.299 g) was diluted with MEK (255.2 g). To this solution was added vinyl sulfone (1.860 g, 80% solids) and cyclobutenediylium, 1,3-bis[2,3-dihydro-2,2-bis[[1-oxohexyl)oxy]methyl]-1H-perimidin-6-yl]-2,4-dihydroxy-, bis(inner salt) (0.354 g).

The barrier layer formulation was prepared at 10.0% solids of Polyester 1 in 2-butanone.

The barrier layer and topcoat formulations were simultaneously coated onto the dried photothermographic imaging layer using a dual knife coating apparatus. The gap for the barrier layer formulation was 1.0 mil (25 μm). The gap for the topcoat formulation was 1.2 mil (30 μm). Coated samples were dried for 2 minutes at 85° C. Thus, the topcoat was the outermost layer of the photothermographic material, and the barrier layer was interposed between it and the imaging layer.

The photothermographic material was converted into three 6.4 cm×30.5 cm samples for image fog testing. Two of the samples of each material were exposed to 25 Watt incandescent lights through Kodak 1A filters for 20 seconds. The third sample of each material was adhered to the first two with masking tape. The samples were then heat-developed with the photothermographic emulsion side down in a Kodak Model 2771 processor having silicone rollers. The exposed portion of the samples entered the processor first. The sample was transported through the processor at 0.36 in/sec (0.91 cm/sec, 2/3 speed).

After heat development, each 30.5 cm sample was evaluated to see how much developed image (fogging) occurred on the unexposed portion due to migration of fogging agent that had evolved from the exposed portion of the sample during processing of the sample. The distance into the sample (in cm) where development occurred such that the optical density had decreased to 1.0 was recorded. A lower distance value is preferred. The "fogging distance" (to 1.0 optical density) was determined to be 0 cm thus indicating no fog.

The invention has been described in detail with particular reference to certain preferred embodiments thereof, but it will be understood that variations and modifications can be effected within the spirit and scope of the invention.

We claim:

1. A thermally developable material comprising a support having thereon:

a) one or more thermally developable imaging layers comprising a binder and in reactive association, a non-photosensitive source of reducible silver ions and a reducing composition for said non-photosensitive source reducible silver ions, and b) a barrier layer that is on the same side of but farther from said support than said one or more imaging layers, said barrier layer comprising a film-forming, water-insoluble aromatic polyester having a molecular weight of at least 10,000 g/mole and a glass transition temperature greater than 150° C.

2. The thermally developable material of claim 1 that further comprises a protective layer that is disposed between said barrier layer and said one or more imaging layers.

3. The thermally developable material of claim 1 wherein said barrier layer is the outermost surface layer.

4. The thermally developable material of claim 1 further comprising an outermost overcoat layer, and said barrier layer is disposed between said outermost overcoat layer and said one or more imaging layers.

5. The thermally developable material of claim 1 wherein said non-photosensitive source of reducible silver ions is a silver fatty acid carboxylate having 10 to 30 carbon atoms in the fatty acid or a mixture of said silver carboxylates.

6. The thermally developable material of claim 1 further comprising a co-developer.

7. The thermally developable material of claim 6 wherein said co-developer is selected from the group consisting of trityl hydrazides, formyl phenyl hydrazides, 3-heteroaromatic-substituted acrylonitriles, 2-substituted malondialdehyde compounds, acrylonitrile compounds, substituted propenitriles, 4-substituted isoxazoles, 2,5-dioxo-cyclopentane carboxaldehydes, 5-(hydroxymethylene)-1,3-dialkylbarbituric acids, and 2-(ethoxymethylene)-1H-indene-1,3(2H)-diones.

8. The thermally developable material of claim 6 further including a contrast enhancing agent.

9. The photothermographic material of claim 8 wherein said contrast enhancing agent is selected from the group consisting of hydroxylamines, alkanolamines, ammonium phthalamate compounds, hydroxamic acid compounds, N-acylhydrazine compounds, and hydrogen atom donor compounds.

10. The thermally developable material of claim 1 that is a photothermographic material further comprising a photocatalyst.

11. The thermally developable material of claim 10 wherein said photocatalyst is a silver halide or mixture of silver halides.

12. The thermally developable material of claim 1 wherein said aromatic polyester is formed by the reaction of one or more dibasic aromatic acids with one or more dihydroxyphenol compounds.

13. The thermally developable material of claim 12 wherein said one or more dibasic aromatic acids are represented by the following Structure I:

I

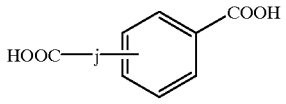

wherein j represents (1) an optional linking group positioned meta or para to the carboxyl group on the phenyl ring, or (2) the atoms necessary to form a 5- or 6-membered fused carbocyclic or heterocyclic ring between any two adjacent carbon atoms of the phenyl ring.

14. The thermally developable material of claim 12 wherein said one or more dihydroxyphenol compounds are represented by the following Structure IIa or IIb:

IIa

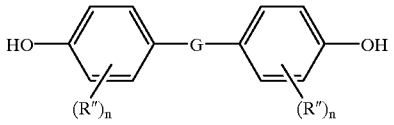

IIb

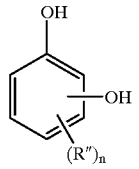

wherein G is a linking group positioned meta or para to each phenolic hydroxy group.

15. The thermally developable material of claim 1 wherein said aromatic polyester is one of the following polyesters.

| Polyester | Structure |
|---|---|
| 1 | 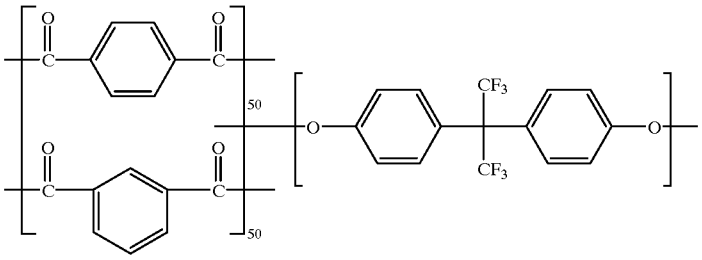 |
| 2 | 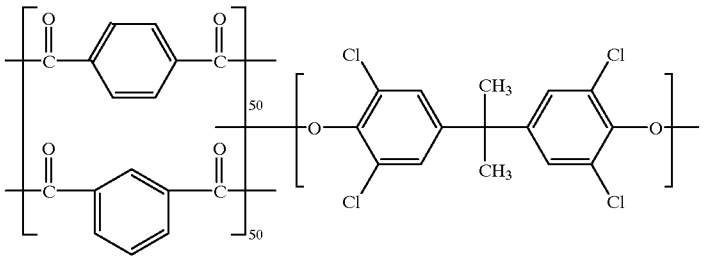 |
| 3 | 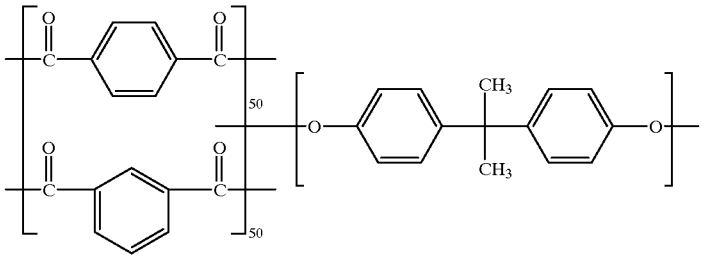 |

-continued

| Polyester | Structure |
|---|---|
| 4 | 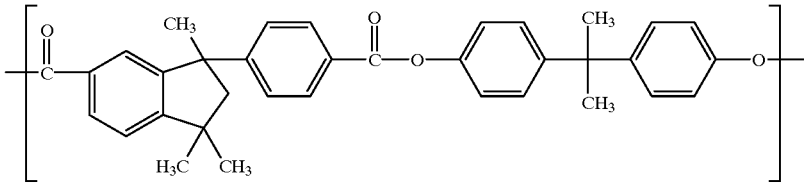 |
| 5 | 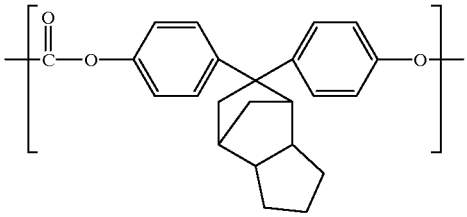 |
| 6 | 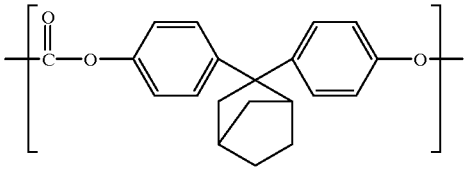 |

16. The thermally developable material of claim 1 that is a photothermographic material that is sensitive to radiation of from about 300 to about 850 nmn.

17. The thermally developable material of claim 1 wherein said barrier layer is capable of retarding the diffusion of or reacting with fatty carboxylic acids.

18. The thermally developable material of claim 17 wherein said barrier layer is capable of retarding the diffusion of or is reactive with behenic acid.

19. A black-and-white photothermographic material comprising a support having on one side thereof:

a) one or more thermally developable imaging layers comprising a binder and in reactive association, a photosensitive silver halide, one or more non-photosensitive silver carboxylates composed of fatty acids having 10 to 30 carbon atoms, or a mixture of said silver carboxylates, and a hindered phenol reducing agent for said silver fatty acid carboxylates, b) a barrier layer that is farther from said support than said one or more imaging layers, said barrier layer comprising a film-forming, water-insoluble aromatic polyester having a molecular weight of at least 10,000 g/mole.

20. The photothermographic material of claim 19 wherein said aromatic polyester is formed from one or more dibasic aromatic acids that are represented by the following Structure I:

I

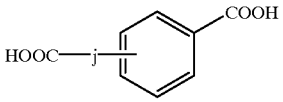

wherein j represents (1) an optional linking group positioned meta or para to the carboxyl group on the phenyl ring, or (2) the atoms necessary to form a 5- or 6-membered fused carbocyclic or heterocyclic ring between any two adjacent carbon atoms of the phenyl ring, reacted with one or more dihydroxyphenol compounds that are represented by the following Structure IIa or IIb:

IIa

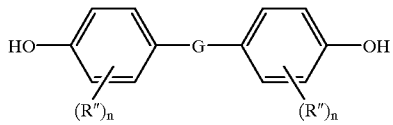

IIb

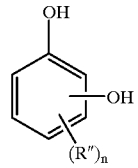

swherein G is a linking group positioned meta or para to each phenolic hydroxy group.

21. The photothermographic material of claim 19 further comprising a toner.

22. The photothermographic material of claim 21 further comprising phthalazine or a derivative thereof as a toner.

23. The photothermographic material of claim 21 wherein at least one of said silver carboxylates is silver behenate.

24. The photothermographic material of claim 21 further comprising a co-developer.

25. The photothermographic material of claim 24 wherein said co-developer is selected from the group consisting of trityl hydrazides, formyl phenyl hydrazides, 3-heteroaromatic-substituted acrylonitriles, 2-substituted malondialdehyde compounds, acrylonitrile compounds, substituted propenitriles, 4-substituted isoxazoles, 2,5-dioxo-cyclopentane carboxaldehydes, 5-(hydroxymethylene)-1,3-dialkylbarbituric acids, and 2-(ethoxymethylene)-1H-indene-1,3(2H)-diones.

26. The photothermographic material of claim 24 further including a contrast enhancing agent.

27. The photothermographic material of claim 26 wherein said contrast enhancing agent is selected from the group consisting of hydroxylamines, alkanolamines, ammonium phthalamate compounds, hydroxamic acid compounds, N-acylhydrazine compounds, and hydrogen atom donor compounds.

28. A photothermographic material comprising a support having thereon:

a) one or more thermally developable imaging layers comprising a binder and in reactive association, a photocatalyst, a non-photosensitive source of reducible silver ions, and a reducing composition for said non-photosensitive source reducible silver ions, and b) a barrier layer that is on the same side of but farther from said support than said one or more imaging layer, said barrier layer comprising a film-forming, water-insoluble aromatic polyester having a molecular weight of at least 8000 g/mole.

29. A method of forming a visible image comprising:

A) imagewise exposing the photothermographic material of claim 28 to electromagnetic radiation to form a latent image, B) simultaneously or sequentially, heating said exposed photothermographic material to develop said latent image into a visible image.

30. The method of claim 29 wherein said photothermographic material has a transparent support and said method further comprises:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

* * * * *